US005791690A

United States Patent [19]

Ong

[11] Patent Number: 5,791,690

[45] Date of Patent: Aug. 11, 1998

[54] SOFT DOCUMENT HOLDER

[76] Inventor: Bon S. Ong, P.O. Box 4247, Torrance, Calif. 90510

[21] Appl. No.: 684,241

[22] Filed: Jul. 19, 1996

Related U.S. Application Data

[63] Continuation-in-part of Ser. No. 349,563, Dec. 5, 1994, Pat. No. 5,566,979.

[51] Int. Cl.[6] ..... B42D 1/00

[52] U.S. Cl. ..... 281/47; 281/21.1; 281/15.1; 281/28; 281/29

[58] Field of Search ..... 281/15.1, 21.1, 281/28, 43, 45–47, 51, 29; 229/67.1–67.3

[56] References Cited

U.S. PATENT DOCUMENTS

| | | | |
|---|---|---|---|
| 706,257 | 8/1902 | Reed | 281/47 |
| 825,474 | 7/1906 | Morris | 281/47 |
| 1,049,311 | 12/1912 | Minor | 281/47 |
| 2,388,960 | 11/1945 | Enzig | 281/47 |
| 2,960,090 | 11/1960 | Shugart | 281/47 |
| 4,138,143 | 2/1979 | Lawes | 281/47 |
| 5,120,075 | 6/1992 | Duggan | 281/47 |
| 5,566,979 | 10/1996 | Ong | 281/21.1 |

FOREIGN PATENT DOCUMENTS

| | | | |
|---|---|---|---|
| 1190938 | 10/1959 | France | 281/47 |
| 816249 | 10/1951 | Germany | 281/47 |
| 417207 | 10/1934 | United Kingdom | 281/47 |
| 557596 | 11/1943 | United Kingdom | 281/47 |
| 752683 | 7/1956 | United Kingdom | 281/47 |

*Primary Examiner*—Frances Han
*Attorney, Agent, or Firm*—Charles H. Thomas

[57] ABSTRACT

A holder for soft-covered documents has first and second components that are both formed of sheetlike materials secured together. The first component forms one of a pair of document covers, either the front or the back cover, and a first attachment strip along an edge of that document cover. The first component also includes a flat, elongated document retaining strip that defines within its structure an elongated document slot. The slot receives some of the pages of a document therethrough such that some of the pages reside on one side of the document retaining strip while the remainder of the pages reside on the other side of the document retaining strip. The first component also includes a first elongated hinge that secures a first attachment strip of the first component to the document retaining strip. The second component forms the other cover and a second attachment strip that is delineated from the other cover by a second hinge. The two attachment strips reside in face-to-face relationship and are secured to each other throughout their lengths by some fastening means, such as a layer of adhesive or a fusion welded interface layer between the attachment strips.

14 Claims, 6 Drawing Sheets

SOFT DOCUMENT HOLDER

SPECIFICATION

The present application is a continuation in part of U.S. application Ser. No. 08/349,563 filed Dec. 5, 1994, now U.S. Pat. No. 5,566,979.

BACKGROUND OF THE INVENTION

1. Field of the Invention

The present invention relates to a folder for a soft-covered document having a plurality of pages.

2. Description of the Prior Art

Among the different types of office supplies available, folders are widely used for carrying numerous different types of documents. One very common type of folder which has a simple construction is formed of a sheet of stiff paper, card stock, plastic, or combination thereof, folded down its center to form a front cover and a back cover. Such a folder forms a protective jacket for papers to be carried. A conventional folder of this type may include only the front and back covers with no additional structure, although frequently the sheet forming the folder is configured to create pockets and sometimes reinforcing edges or margins on the inside surfaces of either the front cover, the back cover, or both.

While conventional folders of this type are perfectly adequate for carrying and protecting unbound papers of standard sizes, they have proven inadequate for carrying multipage soft-covered documents which themselves have front and back covers. Typically, such soft-covered documents are formed of a number of sheets of paper which are folded lengthwise to create two pages out of each sheet. The folded sheets are nested one inside another and bound along their central fold line by staples or adhesives to form a spine. Magazines are typically constructed in this manner as are different types of promotional brochures, business reports, catalogs, and other such documents.

Soft documents of this type cannot be conveniently carried in conventional folders. If multipage soft documents, such as magazines are carried loose between the front and back covers of a folder, they will often fall out of the folder. If they are positioned in pockets of the folder, they still will sometimes fall out of the folder, and in any event are rendered somewhat inaccessible since they must be removed from the pocket for perusal.

SUMMARY OF THE INVENTION

The present invention provides a holder for a soft bound document which includes the front and back covers of a conventional document folder, but which also includes a document holder capable of receiving and capturing soft, bound documents, such as magazines and catalogues. The document holder retains the soft document within the confines of the covers, but allows the pages of the soft document to be completely opened without constraint.

The holder of the invention is formed of two component members. One of these members forms one of the document covers and also the slotted document holder. The other component member forms the opposing cover.

The first component member of the holder includes a first broad expense of cover material, a first narrow attachment region extending along one edge of the first expanse of cover material, and an elongated strip of stiff material that defines therethrough an elongated document receiving slot bounded about its entire perimeter by the structure of the material forming the elongated document retaining strip. The document receiving slot delineates the document retaining strip into an elongated document retaining bar, and an attachment margin by which the document retaining strip is secured to the covers, and a structure that closes both ends of the slot and joins the document retaining bar to the attachment margin of the document retaining strip.

The second component element of the holder of the invention is formed of a second broad expanse of cover material, a second narrow attachment region extending along the second expanse of cover material, and a second hinge connection between the second expanse of cover material and the second attachment region. The first and second narrow attachment regions reside in overlapping, face-to-face relationship to each other. The first and second components are firmly secured together at their attachment regions so that the first and second broad expanses of cover material form front and back folder covers with the document retaining strip enclosed therebetween.

The first and second component members may be formed of soft, flexible materials, such as thin card stock or flexible polypropylene plastic. Preferably, however, at least the expanses of cover material forming the front and back covers and the portion of the first component forming the document retaining strip are relatively stiff in nature.

The first and second document holder components are attached together along their overlapping attachment regions by any suitable means. In one preferred embodiment of the invention a layer of adhesive in interposed between the first and second attachment regions of the first and second components, respectively. The second attachment region of the second component resides on the outside of the first attachment region of the first component so that the retaining strip is held between the front and back covers. The hinge on the first component allows the document retaining strip to be folded either against the inside of the back cover, against the inside of the front cover, or to any intermediate position therebetween. The second hinge on the second component permits the front and back covers to be easily opened and closed relative to each other.

In an alternative embodiment of the invention the first and second components are formed of a fusible material such as polypropylene plastic, polyethylene plastic, or polyvinyl chloride plastic. The first and second component members are then permanently joined together, typically by applying heat thereto, along the narrow first and second attachment regions of the first and second component members, respectively. The heat thus applied creates an elongated weld that extends parallel to the spine of the folder and parallel to the document retaining strip.

In still another alternative embodiment, the first and second components are formed of materials that are fusible together by solvent welding, such as polypropylene plastic. A liquid solvent is applied lengthwise to one or both of the facing surfaces of the attachment regions of the two components. The solvent partially dissolves the surfaces of the facing attachment regions so that when these surfaces are pressed together they become permanently joined to each other when the solvent dries.

Still other embodiments of the invention are possible in which the first and second attachment regions are joined to each other by other fastening means, such as staples, pronged fasteners, or rivets.

To utilize the document holder of the invention once the component members have been joined together, a soft, bound document, such as a magazine, is opened, preferably to its center pages. Half of the pages are then inserted through the document slot so that the first half of the soft document resides on one side of the retaining bar facing the front cover while the last half of the document resides on the other side of the retaining bar facing the back cover.

In one broad aspect the present invention may be considered to be a holder for a soft-covered document having a plurality of pages comprising first and second components. The first component is formed of a first document cover in a pair of document covers; a first attachment strip along an edge of the first document cover; a flat, elongated document retaining strip defining therethrough an elongated document slot bounded about its entire perimeter by the structure of the first component. The slot receives some of the pages of the document therethrough such that they reside on one side of the document retaining strip while the remainder of the pages reside on the other side of the document retaining strip. The first component also defines a first elongated hinge. The first hinge secures the first attachment strip to the document retaining strip.

The second component is formed of a second document cover in the pair of documents covers, a second attachment strip along an edge of the second document cover, and a second elongated hinge that secures the second attachment strip to the second cover. The first and second attachment strips reside in mutually overlapping or juxtaposed relationship. The holder is further comprised of some fastening means that joins the first and second attachment strips together throughout their lengths. The second hinge permits relative rotational movement between the first and second covers and the first hinge permits rotational movement of the document retaining strip relative to both the first and second covers.

In another broad aspect the invention may be considered to be, in combination, a folder formed with front and back covers, each having an inside and an exterior surface; an elongated holder for soft documents having a plurality of pages including a flat member defining entirely within its structure a narrow, elongated document slot that delineates an elongated document retaining bar and an attachment margin wherein the retaining bar and the attachment margin are joined together at opposite, longitudinally separated ends. A first elongated hinge joins the attachment margin of the elongated document holder to a first of the front and back covers. The elongated holder, the first hinge, and the first of the covers are all formed as regions of a first structural component.

The combination also includes a second elongated hinge that has an attachment leaf that secures a second of the front and back covers to the first of the front and back covers, thereby permitting relative rotational movement between the front and back covers. The second hinge and the second cover are all formed as parts of a second component. Some means, such as adhesive, a solvent weld, or a thermal weld, for example, secures the first and second components together throughout their length such that the first hinge and the holder for soft documents resides between the front and back covers.

The hinge on the second component allows the covers to move in rotation relative to each other, while the hinge on the first component allows the soft document retaining strip to rotate freely between the covers. A soft document can thereby be mounted firmly but removably on the document retaining strip and protected between the front and back covers of the document holder.

In a preferred embodiment of the invention the front and back covers of the combination are structurally stiff, as is the elongated soft document holder. These elements should be stiffer than the hinges. To achieve these features the first and second components may be formed with relatively great thicknesses of material delineating the covers and soft document holders, and with thinner areas forming the attachment regions and hinges.

The invention may be illustrated with greater clarity and particularity by reference to the accompanying drawings.

DESCRIPTION OF THE EMBODIMENTS

Figure 1:
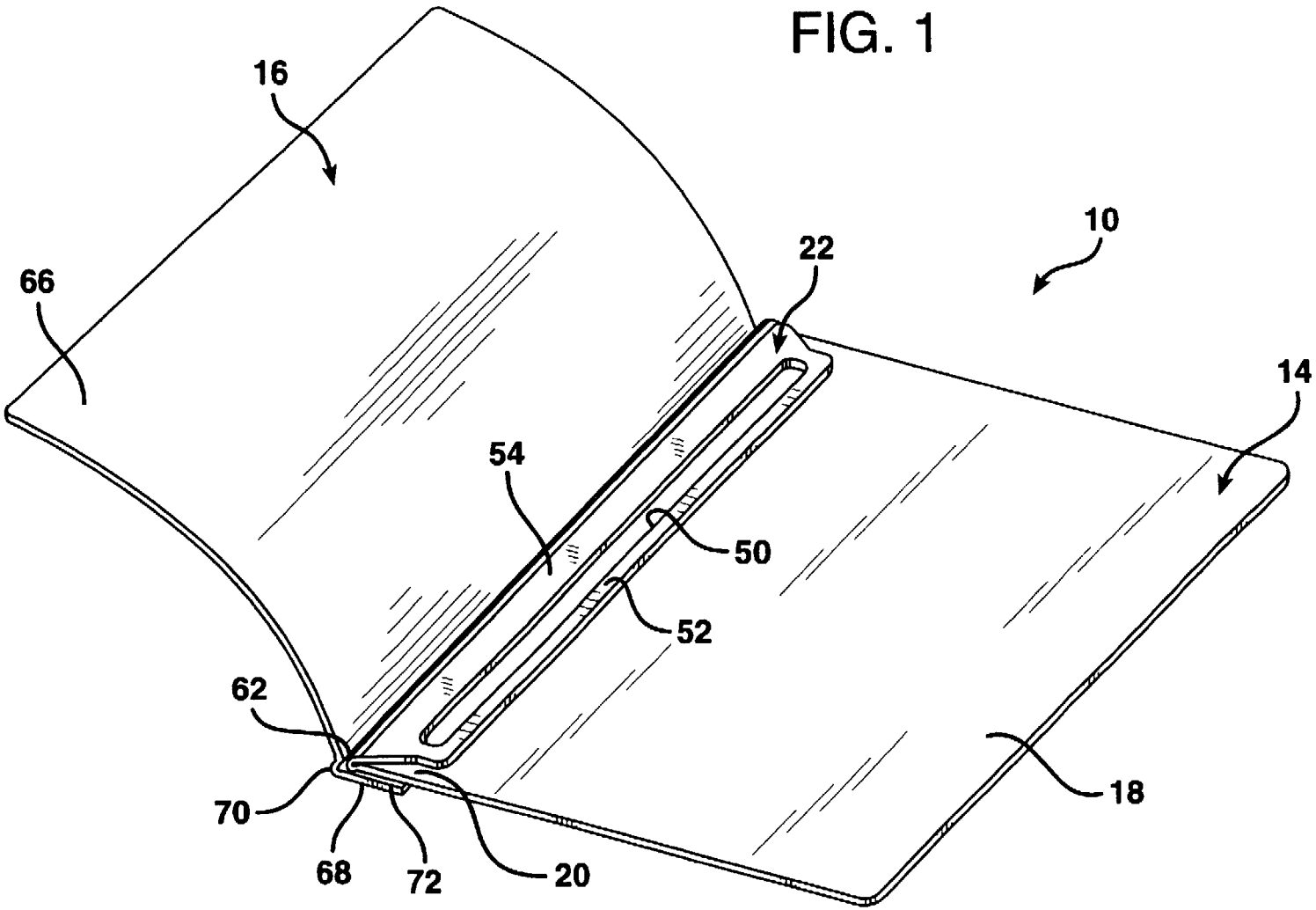
FIG. 1 is a perspective view of one preferred embodiment of the document holder of the invention.
Figure 2:
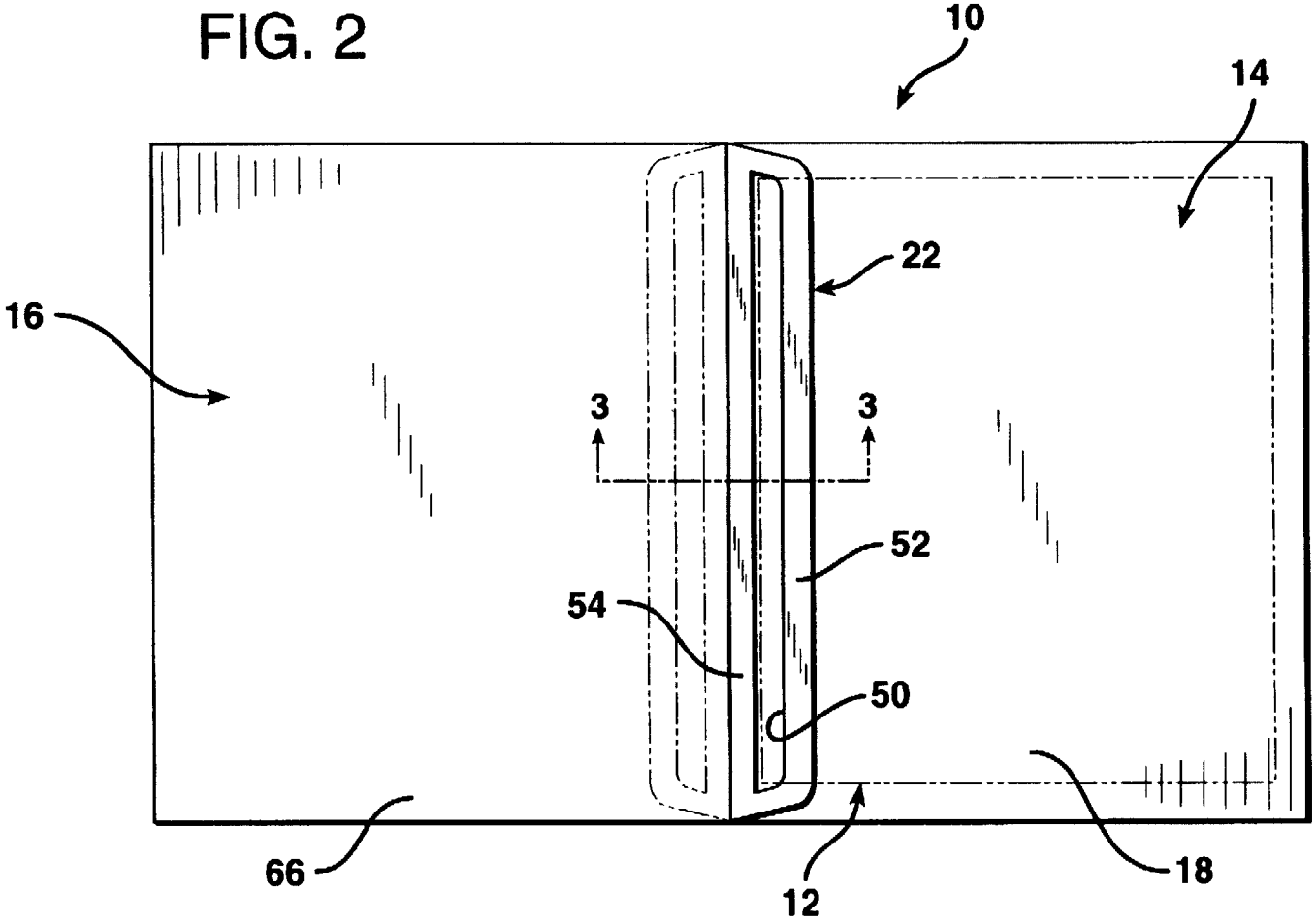
FIG. 2 is a top plan view of the document holder of FIG. 1.
Figure 3:
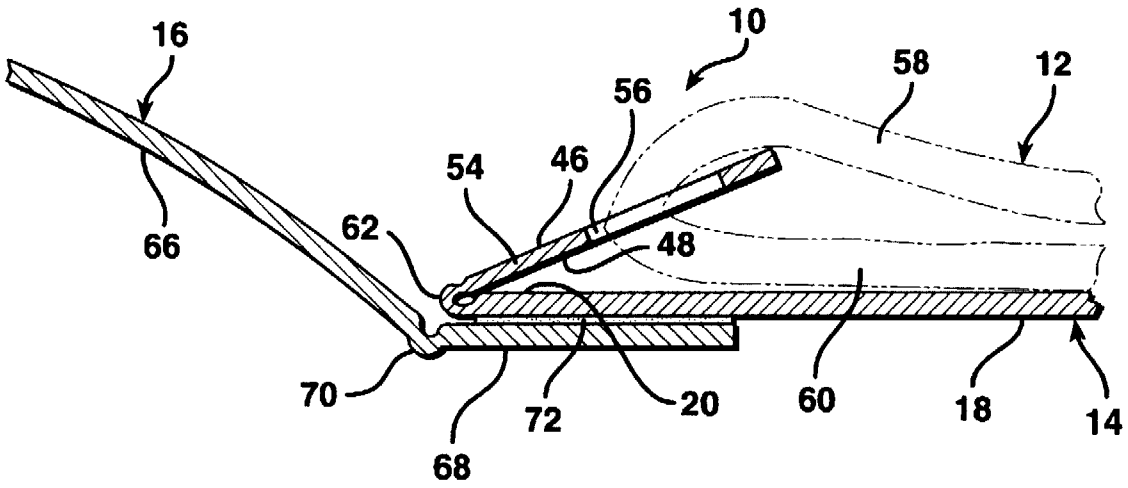
FIG. 3 is a sectional elevational detail taken along the lines 3—3 of FIG. 2.

FIG. 1 illustrates a document holder 10 for holding a soft covered document that is indicted in phantom at 12 in FIG. 3. The document holder 10 is comprised of a first component 14 and a second component 16. In the embodiment of FIGS. 1–3 the components 14 and 16 are both formed of stiff card stock.

The first component member 14 is formed of a first broad expanse of cover material 18 configured in a generally rectangular shape, typically about eleven and three-quarter inches in length and nine and three-eighths inches in width. The broad expanse of cover material 18 serves as the back cover of the document holder 10 and defines a first, narrow attachment region 20 which is about three-quarters of an inch in width and which extends the entire length of the rectangular expanse 18 along its edge adjacent the spine of the folder 10. Beyond the narrow attachment region 20 the first component member 14 also forms a flat, elongated document retaining strip 22.

The first component 14 of the holder 10 may be formed of any material that is stiffer than the soft document to be retained within the holder 10, such as the magazine 12 illustrated in phantom in FIG. 3. The elongated document retaining strip 22 has opposing flat sides 46 and 48 and defines an elongated, narrow, document receiving slot 50 entirely therewithin. The slot 50 extends completely through the thickness of the document retaining strip 22 between the opposite flat sides 46 and 48 thereof. The slot 50 delineates an elongated document retaining bar 52 and a parallel, elongated attachment margin 54. The retaining bar 52 and the attachment margin 54 are joined together at their opposite longitudinally separated ends so that the slot 50 is bounded about its entire perimeter by the structure of the document retaining strip 22, and is defined entirely within the structure of the document retaining strip 22. That is, the slot 50 is an enclosed slot and is not open at either end. Its perimeter lies entirely within the structure of the retaining strip 22.

The size of the slot 50 is selected so that it receives therethrough a substantial number of the pages of the magazine 12. Preferably, the magazine 12 is opened at its center pages where the staples binding the sheets of the magazine pages together are typically visible. One-half of the pages of the magazine 12 are then inserted into the slot 50 and pulled therethrough until the binding 56 of the magazine 12 resides substantially within the slot 50, as illustrated in FIG. 3. The pages of the magazine 12 are thereby split into two sections 58 and 60. The sections 58 and 60 preferably have an equal number of pages, whereby the innermost pages residing in contact with the structure of the holder member 22 on the opposite sides 46 and 48 thereof are formed by different portions of the same folded center sheet of the magazine 12. This facilitates insertion of the magazine pages through the slot 50.

The first component 14 further includes an elongated hinge 62. The hinge 62 is formed as a lengthwise fold extending parallel to the length of the broad expanse of cover material 18, parallel to the spine of the document holder 10. One leaf of the hinge 62 is formed by the attachment margin 54 of the documents retaining strip 22, while the other leaf of the hinge 62 is formed by the attachment region 20 that runs along the edge of the broad back cover expanse 18.

The second component 16 is likewise constructed with a second broad expanse 66 of cover material similar to the first broad expanse 18 of the first component 14. The second broad expanse 66 serves as the front cover of the folder 10. The second component member 16 also includes a narrow attachment region 68 that extends along the second expanse of material 66 and is joined thereto by a second hinge 70. The second hinge 70 forms a hinge connection between the second expanse of cover material 66 and the second attachment region 68. The second attachment region 68 is formed as a narrow attachment strip that extends the length of the document folder 10 and which is substantially the same length as the first attachment region 20. One leaf of the second hinge 70 is formed by the second broad expanse of front cover material 66, while the opposite leaf of the hinge 70 is formed by the second narrow attachment region 68.

The first narrow attachment region 20 and the second narrow attachment region 68 reside in overlapping, juxtaposed relationship to each other, as best depicted in FIG. 3. As illustrated in that drawing figure, a layer of adhesive 72 is interposed between the facing surfaces of the first and second attachment regions 20 and 68. The adhesive layer 72 extends substantially across the entire widths and lengths of both of the attachment regions 20 and 68, and thereby joins the first component 14 and the second component 16 of the document folder 10 together.

The hinge 70 forms the spine of the document folder 10 and allows the front cover 66 and the back cover 18 of the document folder 10 to move in folding rotation relative to each other. The first hinge 62 between the attachment margin 54 and the back cover 18 allows the document retaining strip 22 to be rotated toward the back cover 18 or the front cover 66 as desired. As a result, the flat, stiff document retaining strip 22 can be freely swung either toward the front cover 66, or toward the back cover 18 of the folder 10. This allows other papers to be inserted into the folder 10 on either side of the document retaining strip 22 and to be easily accessible by merely rotating the document retaining strip 22 along its hinge fold line 62 to carry the magazine 12 out of the way.

Different types of fastening systems may be utilized to join the attachment region 20 of the first component 14 and the attachment region 68 of the second component 16. In embodiments of the system in which the hinge 70 is formed of a linear crease in paper stock, this fastening connection is preferably achieved by coating the underside of the attachment region 68 with a layer of pressure-sensitive adhesive 72 throughout its length and width. The underside of the attachment region 20 may thereupon be firmly pressed against the top side of the attachment region 68 of the second component 16 to permanently secure the first and second components 14 and 16 together. If necessary, the interconnection between the first and second components 14 and 16 may be augmented by the use of staples, rivets, or pronged fasteners through the attachment regions 20 and 68.

Figure 4:
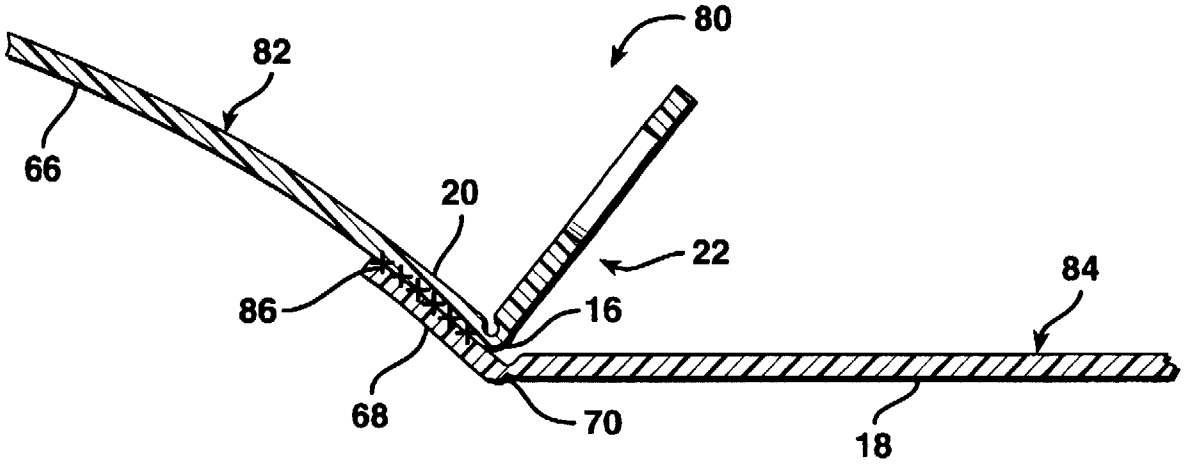
FIG. 4 is a sectional elevational detail illustrating an alternative embodiment of the invention.

FIG. 4 illustrates an alternative embodiment of a holder 80 for soft-covered documents. Both the first component 82 and the second component 84 are formed of plastic sheets that are capable of being fused together. For example, the first and second components 82 and 84 may be formed from sheets of polyvinyl chloride, polypropylene, or polyethylene plastic.

As in the embodiment of FIGS. 1–3, the document holder 80 is formed of a pair of covers, namely a front cover 66 and back cover 18, between which a soft-cover document is enclosed. The pair of covers 66 and 18 and the document retaining strip 22 are formed as stiffened parts of the first and second components 82 and 84. In the embodiment of FIG. 4 the first component 82 forms the front cover 66 while the second component 84 forms the back cover 18 of the document holder 80. The first component 82 has a first attachment strip 20 that extends along an edge of the front document cover 66. Both the first component 82 and the second component 84 are formed of stiff, plastic sheets having a uniform thickness throughout except at necked down areas that form the first and second hinges 62 and 70, respectively. The first component 82, like the first component 14 of the embodiment of FIGS. 1–3, forms a flat, elongated document retaining strip 22 having the construction described in connection with FIGS. 1–3. The second component 84 which forms the back cover 18 of the holder 80 has a second attachment strip 68 that extends along an edge of the back document cover 18 and which forms an attachment leaf of the hinge 70. The back cover 18 forms the other leaf of the hinge 70.

In the embodiment of FIG. 4 the first and second components 82 and 84 are not secured to each other by adhesive. Rather, the first attachment strip 20 of the first holder component 82 and the second attachment strip 68 of the second holder component 84 are fusion welded or solvent welded together throughout their interface 86 of mutual contact. Whether fusion welded or solvent welding is employed, the first and second attachment strips 20 and 68 are permanently fused together in a mutually overlapping relationship. The melted interface 86 where areas of the first and second attachment strips 20 and 68 are fused together forms the fastening means that joins the first and second attachment strips 20 and 68 together throughout their lengths.

The first component 82 has a longitudinal, linear region of reduced thickness that delineates the document retaining strip 22 from the first attachment region 20 of the first component 18. The region of reduced thickness thereby serves as the hinge 62 between the document retaining strip 22 and the front and back covers 66 and 18 of the document holder 80.

Similarly, the linear, longitudinal reduction in thickness of the plastic sheet of which the second component 84 is constructed delineates the second attachment region 68 from the back cover 18 and serves as the second hinge 70. Hinges formed in this manner by delineating linear reductions in thickness between two segments of a plastic article are sometimes referred to as "living" hinges. As in the embodiment of FIGS. 1–3, the second hinge 70 permits relative rotation movement between the front cover 66 and the back cover 18, while the first hinge 62 permits rotational movement of the document retaining strip 22 relative to both the front cover 66 and the back cover 18.

Figure 5:
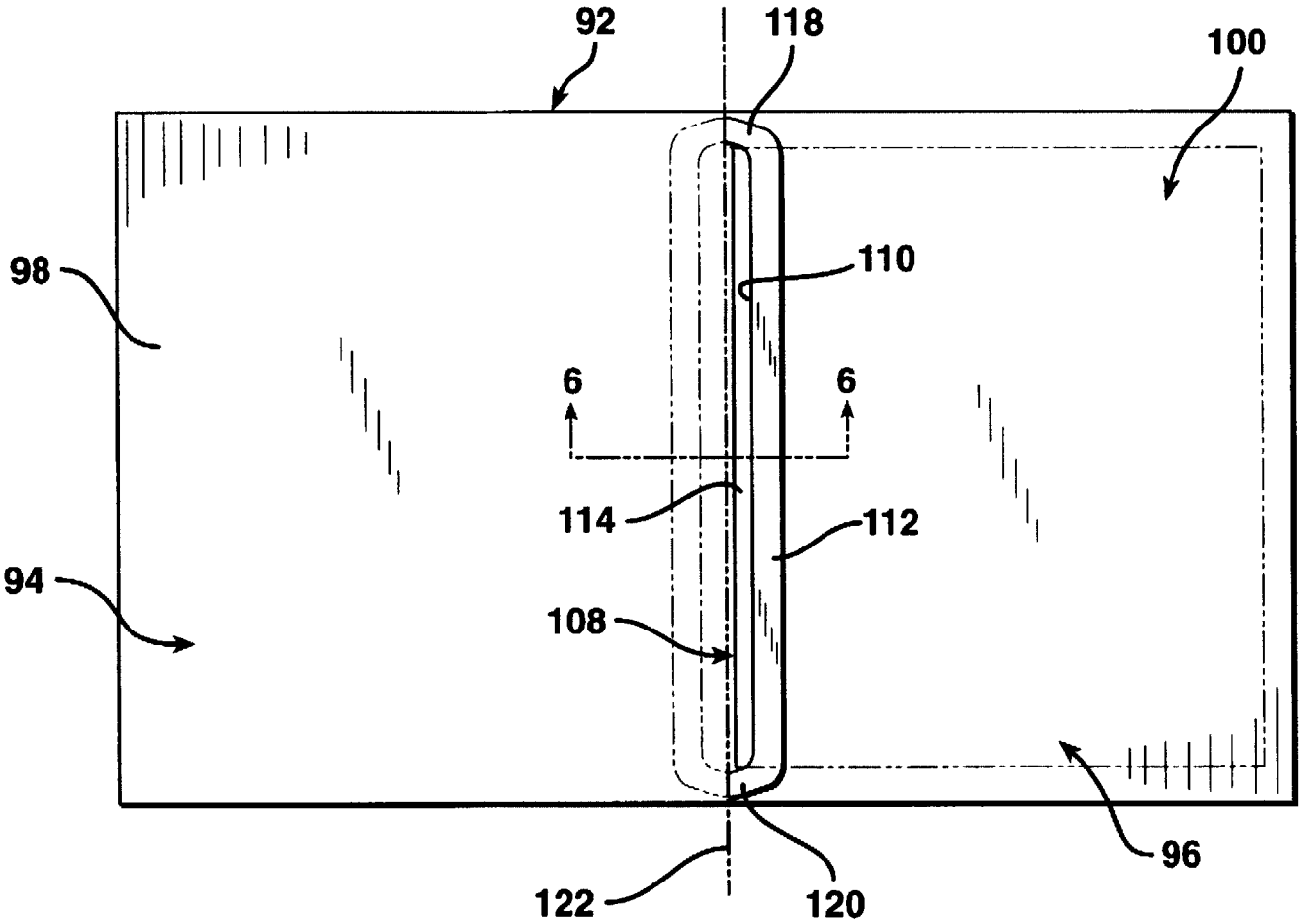
FIG. 5 is a top plan view illustrating another alternative embodiment of the invention.
Figure 6:
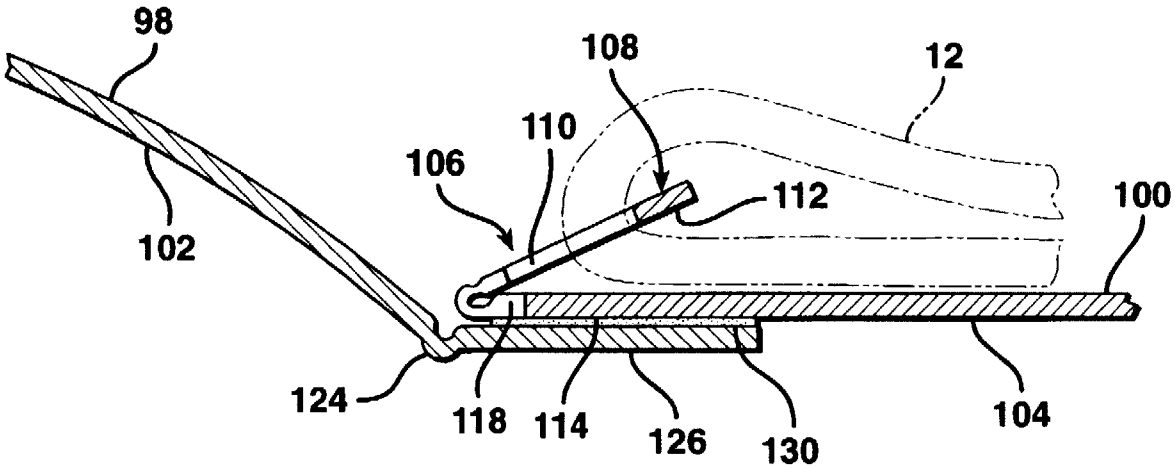
FIG. 6 is a sectional elevational detail taken along the lines 6—6 of FIG. 5.

FIGS. 5 and 6 illustrate an another embodiment of a document holder constructed according to the invention. FIG. 5 illustrates a folder 92 formed with a front cover 94 and a back cover 96 having interior surfaces 98 and 100 and exterior surfaces 102 and 104, respectively. The folder 92 also includes an elongated holder 106 for soft documents, such as the magazine 12 having a plurality of pages. The elongated holder 106 includes a member 108 that defines entirely within its structure a narrow, elongated slot 110 that delineates an elongated document retaining bar 112 and an attachment margin 114. The attachment margin 114 and the retaining bar 112 are joined together at opposite longitudinally-separated ends by end connecting bridges 118 and 120, which fold along a common axis 122, shown in FIG. 5. The connecting bridges 118 and 120 form a first elongated hinge that joins the retaining bar 112 to the back cover 96. The elongated holder 106, the first hinge formed by the bridges 118 and 120, the attachment margin 114, and the back cover 96 are all formed as regions of a first structural component of the folder 92.

A second elongated hinge 124 has an attachment leaf 126 that secures the front cover 94 to the back cover 96. The second elongated hinge 124 may be formed as an area of reduced thickness between the front cover 94 and the attachment leaf 126 and permits relative rotational movement between the front cover 94 and the back cover 96. The second hinge 124, the attachment leaf 126 and the front cover 94 are all formed as parts of a second component of the folder 92. An adhesive layer 130 secures the first and second components of the folder 92 together throughout their lengths such that the first hinge formed by the folding of the bridges 118 and 120 along the axis 122 resides between the front cover 94 and the back 96.

The embodiment of FIGS. 5 and 6 differs from that of FIGS. 2 and 3 primarily in that the hinge connecting the retaining bar 112 of the member 108 to the cover to which it is attached, which is the back cover 96, resides entirely within the structure of the member 108, rather than between the elongated document holder and the cover to which it is attached.

Figure 8:
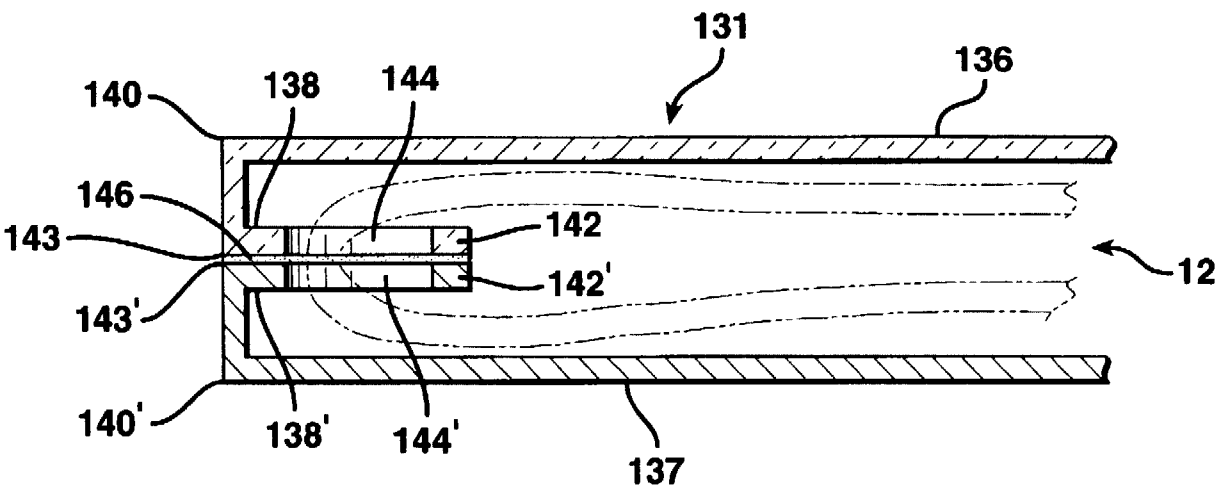
FIG. 8 is a transverse sectional view of an embodiment of the invention employing the components of FIG. 7.
Figure 7:
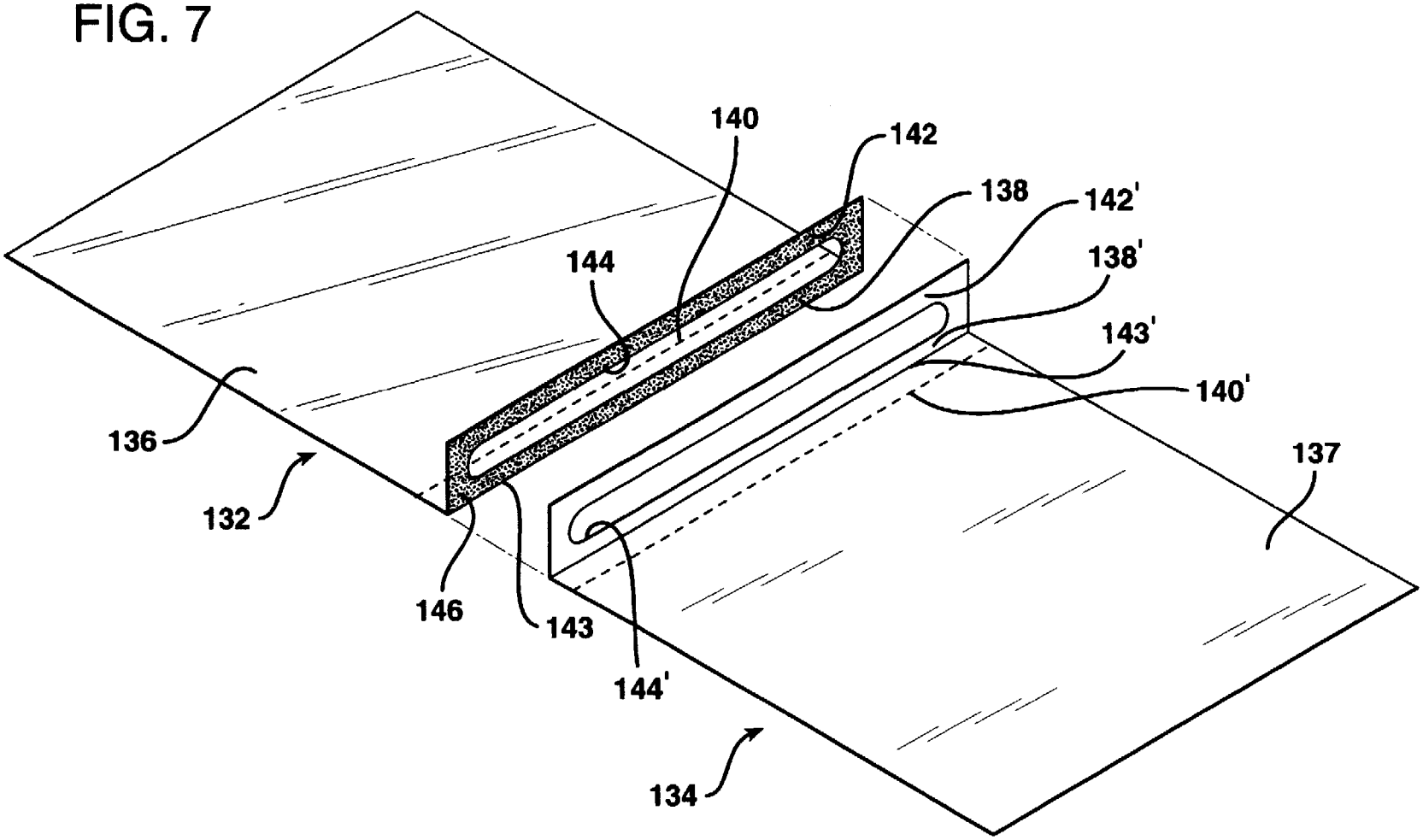
FIG. 7 is an exploded perspective view of the components of another embodiment of the invention.

FIGS. 7 and 8 illustrate another alternative embodiment of a holder 131 for a soft covered document. The holder 131 is advantageous in that it is formed of two identical die cut sections 132 and 134.

The holder 131 is formed of a first component 132 forming a first document cover, namely the top cover 136, in a pair of documents covers 136 and 137. Together the front document cover 136 and the back document cover 137 cover a soft document, such as a magazine 12 having a plurality of pages therein, indicated in phantom in FIG. 8.

The first component 132 has a first attachment strip 138 proximate an edge 140 of the front cover 136. The edge 140 is defined with a line of weakness thereon so as to aid in creating a spine for the holder 131. The first component 132 also defines a flat, elongated document retaining strip 142 located proximate the attachment strip 138. In fact the document retaining strip 142 and the attachment strip 138 are both parts of a single flap delineated by a binding fold line 143. The document retaining strip 142 and the attachment strip 138 define therebetween an elongated document slot 144 bounded about its entire perimeter by the structure of the first component 132. The slot 144 receives some of the pages of the document 12 therethrough such that they reside on one side of the document retaining strip 142, while the remainder of the pages reside on the other side of the document retaining strip 142. A first elongated hinge formed along the folded edge 140, as depicted in FIG. 8, secures the first document cover 136 to the document retaining strip 142.

The second component 134 is identical in structure to the first component 132, so that a single die can be used to form the entire holder 131. The second component 134 forms the second, namely the back document cover 137 in the pair of document covers 136 and 137. The second component 134 also forms a second attachment strip 138' proximate an edge of the back document cover 137. A second elongated hinge, formed by a fold along the line of weakness 140' is defined on the second component 134. The second elongated hinge 140' secures the second attachment strip 138' to the back cover 137. Like the first component 132, the second component 134 has a document retaining strip 142', which together with the second attachment strip 138', defines an elongated slot 144' entirely within the structure of the second component 134. The first attachment strip 138 of the first component 132 and the second attachment strip 138' of the second component 134 reside in mutually juxtiposed relationship, as depicted. The second component 134 also has a binding fold line 143'.

Both of the attachment strips 138 and 138' and also the corresponding document retaining strips 142 and 142' are covered with adhesive indicated at 146 in FIG. 7. The double layer of adhesive 146 joins the first and second attachment strips 138 and 138' together throughout their lengths, as shown if FIG. 8. Alternatively, however, the adhesive layers may cover only the attachment strips 138 and 138'. Also, fasteners other than adhesive may be used to join the attachment strips 138 and 138' together.

Undoubtedly, numerous other variations and modifications of the invention will become readily apparent to those familiar with office supply products. Alternative fastening means may be employed to those illustrated in the embodiments described. For example, staples, rivets, flexible fabric hook and loop fastening strips, pronged fasteners, and other conventional fastening means suitable for fastening mutually facing areas of flat stock together may be employed in place of the layer of adhesive and fused interface layer between the first and second attachment strips depicted in the embodiments illustrated. Accordingly, the scope of the invention should not be construed as limited to the specific embodiments depicted and described herein.

What is claimed is:

1. A holder for a soft-covered document having a plurality of pages comprising a first component member formed of a first broad expanse of cover material, a first narrow attachment region extending along one edge of said first expanse of cover material, and a flat, elongated document retaining strip defining therethrough an elongated document receiving slot bounded about its entire perimeter by the structure of said document retaining strip, said slot receiving some of said pages of said document therethrough such that they reside on one side of said strip while the remainder of said pages reside on the other side of said strip, and a first hinge connection between said first attachment region and said document retaining strip, and a second component member formed of a second broad expanse of cover material and a second narrow attachment region extending along said second expanse of cover material and a second hinge connection between said second expanse of cover material and said second attachment region, and wherein said first and second narrow attachment regions reside in overlapping relationship to each other, and wherein said first and second components are firmly secured together at said attachment regions so that said first and second broad expanses of cover material form front and back folder covers with said document retaining strip enclosed therebetween.

2. A holder according to claim 1 further comprising a layer of adhesive interposed between and joining together said first and second attachment regions.

3. A holder according to claim 1 wherein said first and second components are comprised of a fusible material and said fusible material of each of said components is fused together along said attachment regions.

4. A holder according to claim 1 wherein said broad expanses of cover material and said document retaining strip are stiff and said hinge connections are formed by lines of reduced thickness in said first and second components.

5. A holder according to claim 4 wherein said first and second components are comprised of sheets of polypropylene plastic.

6. A holder for a soft-covered document comprising:

a first component forming a first document cover in a pair of document covers for covering a soft document having a plurality of pages therein, a first attachment strip proximate an edge of said first document cover, a flat, elongated document retaining strip proximate said first attachment strip and defining an elongated document slot bounded about its entire perimeter by structure of said first component, said slot receiving some of said pages of said document therethrough such that they reside on one side of said document retaining strip while the remainder of said pages reside on the other side of said document retaining strip, and a first elongated hinge that secures said first document cover to said document retaining strip, a second component forming a second document cover in said pair of document covers, a second attachment strip proximate an edge of said second document cover, and a second elongated hinge that secures said second attachment strip to said second cover, and wherein said first and second attachment strips reside in mutually juxtaposed relationship, and a fastening means that joins said first and second attachment strips together throughout their lengths.

7. A holder according to claim 6 wherein said fastening means is comprised of a layer of adhesive extending between said attachment strips so as to adhesively secure said attachment strips to each other.

8. A holder according to claim 6 wherein said first and second components are comprised of fusible plastic and said fastening means is comprised of areas on said attachment strips that are fused together.

9. A holder according to claim 6 wherein said pair of covers and said document retaining strip are formed as stiffened parts of said first and second components.

10. In combination, a folder formed with front and back covers each having an inside and an exterior surface, an elongated holder for soft documents having a plurality of pages including a member defining entirely within its structure a narrow, elongated document slot that delineates an elongated document retaining bar and an attachment margin wherein said retaining bar and said attachment margin are joined together at opposite longitudinally separated ends, and further comprising a first elongated hinge that joins said retaining bar of said elongated holder to a first of said front and back covers, and wherein said elongated holder, said first hinge and said first of said covers are all formed as regions of a first structural component, and further comprising a second elongated hinge that has an attachment leaf that secures a second of said front and back covers to said first of said front and back covers, thereby permitting relative rotational movement between said front and back covers, and wherein said second hinge and said second cover are all formed as parts of a second component, and further comprising means for securing said first and second components together throughout their lengths such that said first hinge resides between said front and back covers.

11. A combination according to claim 10 wherein said means for securing said first and second components together is comprised of portions of said attachment leaf of said second hinge and said first component that are fused together.

12. A combination according to claim 10 wherein said means for securing said first and second components together is comprised of a layer of adhesive interposed therebetween.

13. A combination according to claim 10 wherein said first and second components are formed of plastic.

14. A combination according to claim 10 wherein said front and back covers and said elongated holder are all structurally stiff.

* * * * *